US006056286A

United States Patent [19]

Koga

[11] Patent Number: 6,056,286

[45] Date of Patent: May 2, 2000

[54] AUTOMATIC CUT-SHEET FEEDER

[75] Inventor: Yuji Koga, Nagoya, Japan

[73] Assignee: Brother Kogyo Kabushiki Kaisha, Nagoya, Japan

[21] Appl. No.: 09/112,338

[22] Filed: Jul. 9, 1998

[30] Foreign Application Priority Data

Nov. 14, 1997 [JP] Japan ..... 9-331266

[51] Int. Cl.[7] ..... B65H 1/00

[52] U.S. Cl. ..... 271/145; 271/171

[58] Field of Search ..... 271/161, 171, 271/145, 162; 347/104; 400/624, 642

[56] References Cited

U.S. PATENT DOCUMENTS 5,121,169 6/1992 Kawabata ..... 271/171 X

FOREIGN PATENT DOCUMENTS 6191649 7/1994 Japan ..... 271/161

*Primary Examiner*—David H. Bollinger
*Attorney, Agent, or Firm*—Oliff & Berridge, PLC

[57] ABSTRACT

An automatic cut-sheet feeder is provided having an extendible guide for preventing the upper section of a sheet from hanging down, even if the extendible guide does not reach the upper edge of the sheet because of downsizing this feeder. The automatic cut-sheet feeder for a printer includes a sheet stacking section for stacking at least one printing sheet and an extendible guide for supporting a sheet from its back surface, which is disposed at the upstream side, in the sheet feeding direction of the section. The extendible guide has a low section located centrally in the sheet width direction. The low section is lower than both side sections, which are outwardly protruding and supports the sheet such the sheet is curved in the width direction of the sheet.

33 Claims, 9 Drawing Sheets

AUTOMATIC CUT-SHEET FEEDER

BACKGROUND OF THE INVENTION

1. Field of Invention

The present invention relates to an automatic cut-sheet feeder for feeding a sheet into an image forming apparatus, for example, a printer or a copying machine. Specifically, the present invention relates to a sheet feeding guide, which can feed a sheet successfully even if the guide is small-sized, and an automatic cut-sheet feeder which can be easily installed on and removed from an image forming apparatus and efficiently received inside the image forming apparatus.

2. Description of Related Art

A conventional automatic cut-sheet feeder retains a stack of plural printing cut-sheets (referred to merely as sheets, hereinafter) which are cut into an A4 size (210×297 mm) and successively feeds the sheets, one by one, into an image forming apparatus. Recently, the automatic cut-sheet feeder has been required to be smaller in size to improve space efficiency. In particular, portable automatic cut-sheet feeders need to be made even smaller.

Conventionally, a longitudinal form automatic cut-sheet feeder is known in which a sheet stacking section is attached to an image forming apparatus body upstream, along the sheet feeding direction, so as to be inclined obliquely upward toward the body.

In this conventional feeder, a sheet is supported to stand up obliquely. Thus, an extendible guide which can be received inside the feeder is attached to the automatic cut-sheet feeder in such a manner that the supported sheet will not be bent and its upper edge section will not fall down and backwards.

For an extendible guide is known which is attached to the body of the automatic cut-sheet feeder so as to be able to be received inside the body, and to be able to be pulled out toward the upstream side along the sheet feeding direction and fixed at such a position that the guide is projected from the body.

However, when the automatic cut-sheet feeder is made smaller, the extendible guide which can be received inside the feeder must be made smaller. Such an extendible guide may result in the following inconveniences. That is, even if the extendible guide is extended so that a sheet is set thereon, the extendible guide does not reach the upper section of the sheet and cannot support the upper section. Therefore, that section hangs down off the guide. A rod-like extendible guide may be used which can support only the central section of a sheet; however, the upper and both side sections of the sheet hang down as a result. Therefore, the sheet cannot be fed into the image forming apparatus successfully. The size of the extendible guide, therefore, restricts the size of the sheet which can be applied to the automatic cut-sheet feeder. For this reason, when making an automatic cut-sheet feeder wherein sheets having various sorts of sizes, e.g., A4-, letter- and post card-sizes are used, the plane area of the extendible guide and the size of the feeder automatic cut-sheet body receiving the guide are large, so that such various sheet sizes may be used. These large sizes, however, cause the feeders to be larger in size rather than smaller.

Even if improvements to printers further reduce the size of printers, the automatic cut-sheet feeder needs to have storage space for stacking sheets, i.e., space for a sheet stacking section, a sheet feeding mechanism and the like attached to the feeder. For this reason, and because image forming apparatuses are being made far smaller, the relative imbalance of the size of the image forming apparatus and the size of the sheet feeder attached thereto is compounded. For example, when stacking a large number of sheets onto a longitudinal type automatic cut-sheet feeder and attaching this feeder to a small portable image forming apparatus, stability of the small portable image forming apparatus is largely damaged. The image forming apparatus may tip over because of the weight of the stacked sheets and hanging-down of the upper section of the sheets. In order to maintain stability of the image forming apparatus, the automatic cut-sheet feeder would need to be made small and, consequently, the number of stacked sheets would have to be reduced.

To improve the above-mentioned instability, automatic cut-sheet feeder may be attached to the lower section of an image forming apparatus. In this case, to provide a sheet from the sheet feeder and subsequently feed the sheet into the image forming apparatus, it is necessary to reverse the sheet orientation by 180 degrees. This orientation frequently causes the sheets to jam in the feeder because of the complexity of the image forming apparatus mechanism. Additionally, the orientation causes the stacking capacity to be limited and the print starting position of the sheets to be wrongly positioned, which feeds the sheet obliquely.

SUMMARY OF THE INVENTION

Therefore, an aspect of the present invention is to provide an automatic cut-sheet feeder having an extendible guide for preventing the upper section of a sheet from hanging down even if the extendible guide does not reach the upper edge of the sheet because of downsizing this feeder.

Another aspect of the invention is to provide an automatic cut-sheet feeder which, even if the feeder is made large relative to an image forming apparatus resulting in imbalance therebetween, can maintain the stability of the image forming apparatus to which the feeder is attached without the image forming apparatus portability being damaged.

In order to accomplish these objects, an automatic cut-sheet feeder for an image forming apparatus according to a first aspect of the present invention comprises a sheet stacking section for stacking at least one printing sheet and an extendible guide for supporting a sheet from its back surface. The extendible guide is disposed at the upstream side, in the sheet feeding direction, of the sheet stacking section. The extendible guide has a central section in the sheet width direction which is lower than both side sections and supports the sheet in a manner that the sheet is curved in the sheet width direction.

According to the automatic cut-sheet feeder having this structure, the extendible guide has a low section positioned at the central section in the sheet width direction, which is lower than both side sections. For this reason, the central section of the sheet stacked in the sheet stacking section sinks because of the weight of the sheet. Therefore, the sheet is bent roundly around its upper end section to form into an arcuate, curved surface. As a result, the upper end section of the sheet becomes stiff providing an advantage that the sheet is not likely to hang down.

In the automatic cut-sheet feeder according to a second aspect of the present invention, the structure according to first aspect of the present invention is included and the extendible guide is composed of a pair of sub-guide members disposed at the upper and both sides of the sheet stacking section, arranged to be received inside the sheet stacking section. According to the automatic cut-sheet feeder having this structure, the extendible guide is received inside the sheet stacking section, for example, when the feeder is carried. Therefore, when using the feeder, the extendible guide is spread to support the sheet securely. When carrying the feeder, the extendible guide is received inside the sheet stacking section so as not to obstruct carrying.

In the automatic cut-sheet feeder according to a third aspect of the present invention, the structure according to the second aspect of the present invention is included and the pair of the members is axially supported to the upper and both sides of the sheet stacking section so as to be rotated. According to the automatic cut-sheet feeder having this structure, the extendible guide can support and guide a longer and wider sheet more securely than an extendible guide that can be slid linearly for extension, even if the guide is attached to the image forming apparatus having a short length along the sheet longitudinal direction.

In the automatic cut-sheet feeder according to a fourth aspect of the present invention, the structure according to the third aspect of the present invention is included and the extendible guide has a bottom for supporting the sheet from its back surface and an extendible guide sidewall for guiding the sheet from its side edge. A sheet inserting opening of the sheet stacking section is closed with the extendible guide sidewall when the pair of the axially supported extendible guides are received inside the sheet stacking section.

According to the automatic cut-sheet feeder having this structure, it is possible to prevent invasion of alien substances into a small-sized automatic cut-sheet feeder when the feeder is transported. Even if the feeder is used without being carried, such invasion as above can be reduced.

The automatic cut-sheet feeder according to a fifth aspect of the present invention, which is attached to an image forming apparatus so as to be installed on and removed the apparatus, comprises a slender leg connected to the bottom section of the feeder so as to be rotated horizontally and rotated along the direction crossing the longitudinal direction of the bottom section of the feeder to support the feeder so that the feeder independently stands up. An engaging section is disposed at the end section of the leg for engaging the feeder with the image forming apparatus. The end section is positioned near the image forming apparatus when the leg is rotated along the direction crossing the longitudinal direction of the bottom section of the feeder.

According to the automatic cut-sheet feeder having this structure, even if the feeder is larger than the smaller image forming apparatus, for example, a lengthwise type feeder, the legs support the image forming apparatus so stability is improved. Even if the image forming apparatus is disengaged to make the feeder independent, the feeder can stand up by itself. Also, when the feeder is stored, the support legs of the feeder reduce the necessary storage area. Thus, only a small storage space is necessary. Furthermore, the support legs are axially connected to the bottom section of the feeder to be freely rotated; therefore, the legs can be rotated toward the bottom area and received by overlapping the bottom area. Thus, the degree of portability of the feeder is not decreased. The end section of the support legs nearest the image forming apparatus is equipped with an engaging hook. Thus, even if another hook is not used, the support legs can be used so that the feeder can engage with the image forming apparatus.

The automatic cut-sheet feeder according to a sixth aspect of the present invention has the structure according to the fifth aspect of the present invention and a hook engaging with the image forming apparatus so that the feeder is engaged with the apparatus with the hook and the engaging section.

According to the automatic cut-sheet feeder having this structure, the simply structured hook of the leg is used to engage the feeder with the image forming apparatus securely.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

The following will describe embodiments according to the present invention, referring to the attached drawings.

Figure 1:
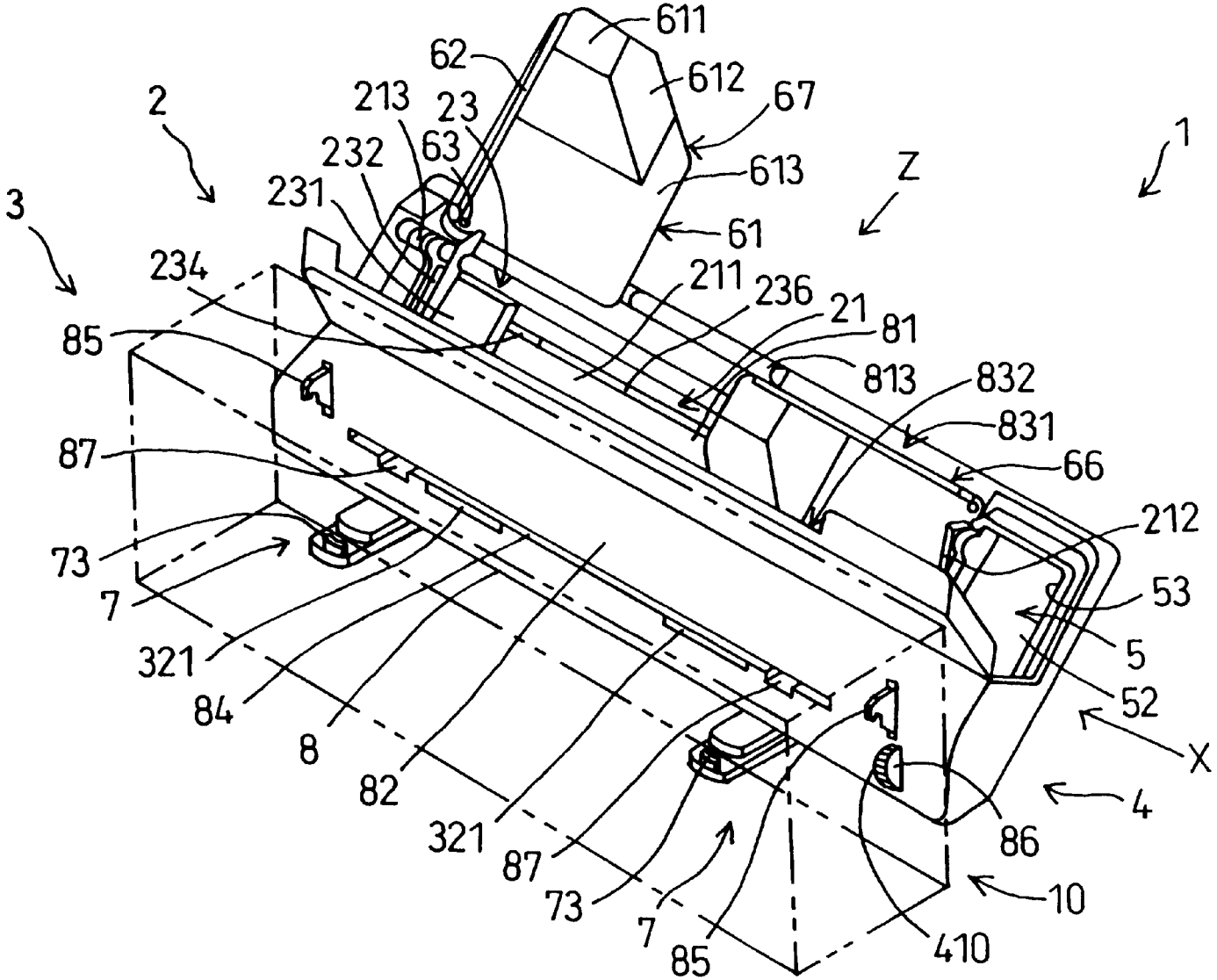
FIG. 1 is an elevational, perspective view illustrating an external appearance of an automatic cut-sheet feeder.

FIG. 1 is an elevational, perspective view illustrating an external appearance of an automatic cut-sheet feeder 1 according to an embodiment of the present invention.

As illustrated in FIG. 1, the automatic cut-sheet feeder 1 is fitted to the sheet feeding side of an image forming apparatus, for example, a small-sized, portable ink jet printer 10, so as to be freely installed on and removed from the image forming apparatus. A body frame 8 serves as a body case and is made of a plastic material. The body frame 8 is made into a box-like member which has a substantially rectangular shape viewed from the front and is mounted at an upstream side of the image forming apparatus along the sheet feeding direction to be inclined obliquely upwards at an angle of about 55 degrees from the horizontal face. The lower section of the body frame 8 has a form which somewhat expands toward the front.

A sheet stacking section 2 for stacking a plurality of cut-sheets for printing is arranged at an upper section inside the body frame 8. A sheet feeding roller section 3 is arranged at the lower section inside the body frame 8. A roller driving section 4 is arranged at the right side, viewed from the front, of the sheet feeding roller section 3. An ink cartridge receiving section 5 for receiving a spare ink cartridge is arranged at the right side, viewed from the front, of the sheet stacking section 2 and above the roller axis driving section 4.

The ink cartridge 51 used in the printer 10 according to the present embodiment is preferably used for ink jet recording using a liquid ink and contains therein the liquid ink.

Figure 2:
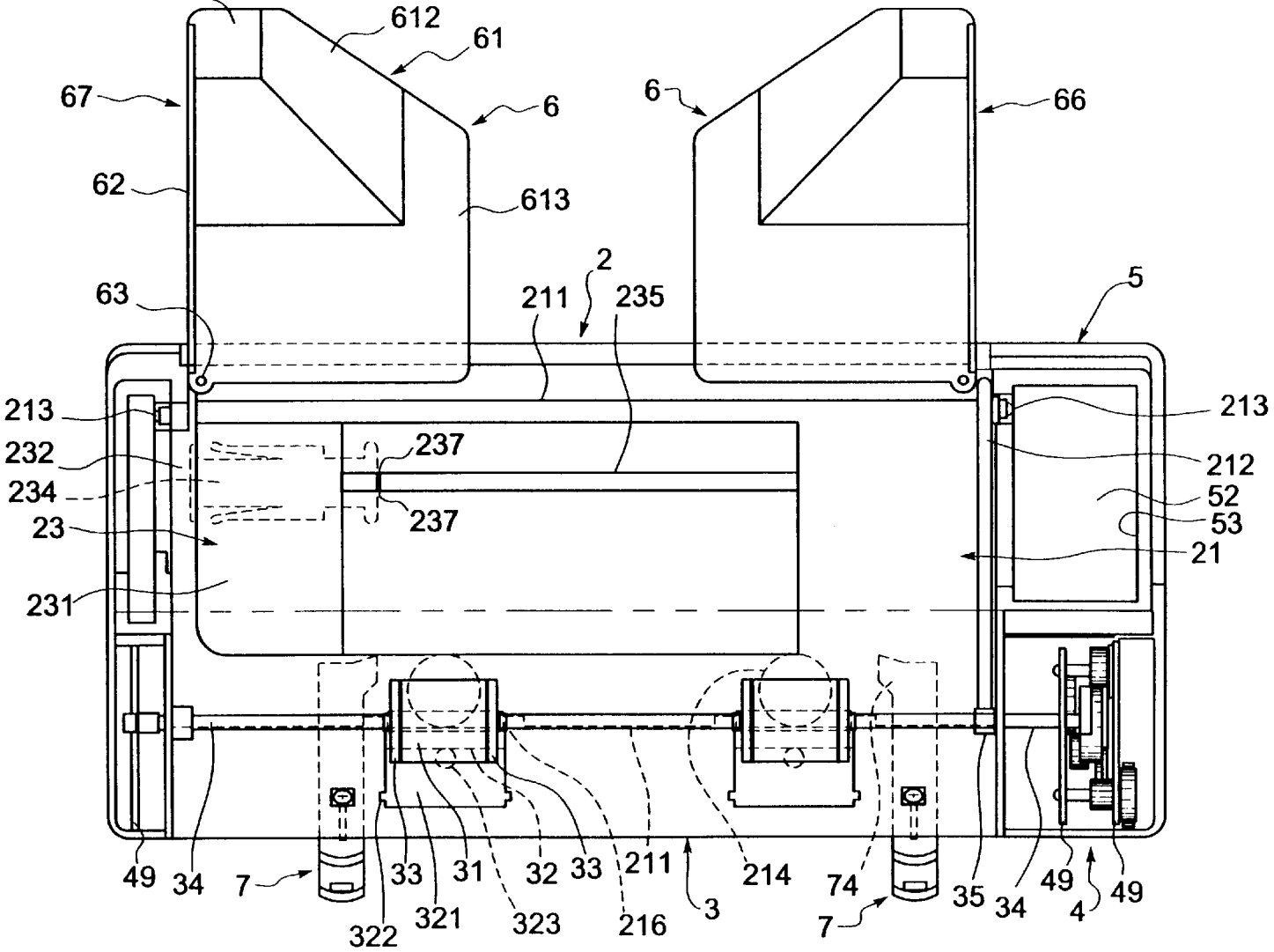
FIG. 2 is a view illustrating the automatic cut-sheet feeder in which extendible guides and legs are spread and opened, viewed from the Y direction in FIG. 1, wherein the upper section of a body case and a cover of a sheet stacking section are omitted.
Figure 3:
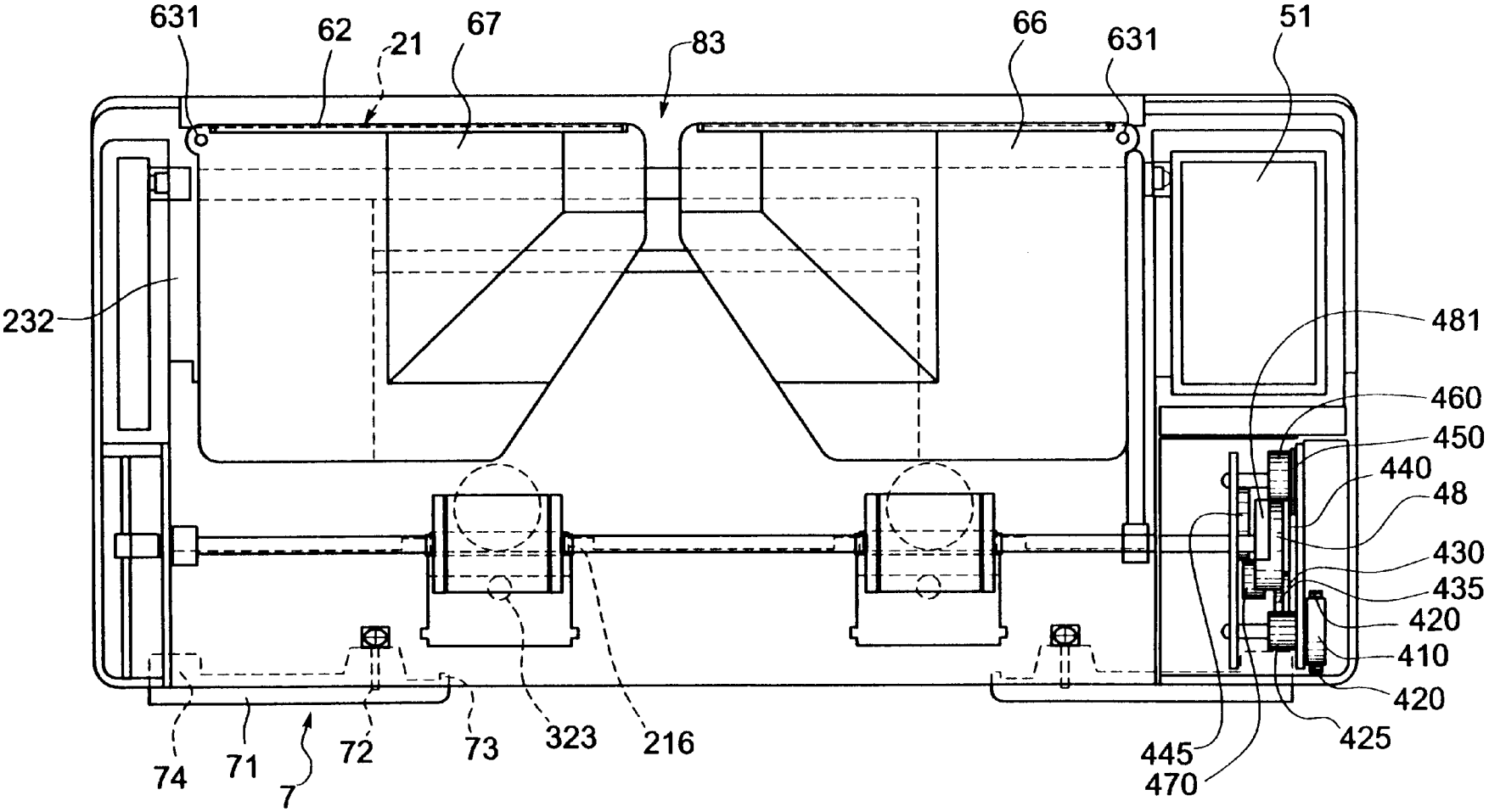
FIG. 3 is a view illustrating the automatic cut-sheet feeder in which the extendible guides and legs are closed, viewed from the Y direction in FIG. 1, wherein the upper section of a body case and a cover of a sheet stacking section are omitted.
Figure 10:
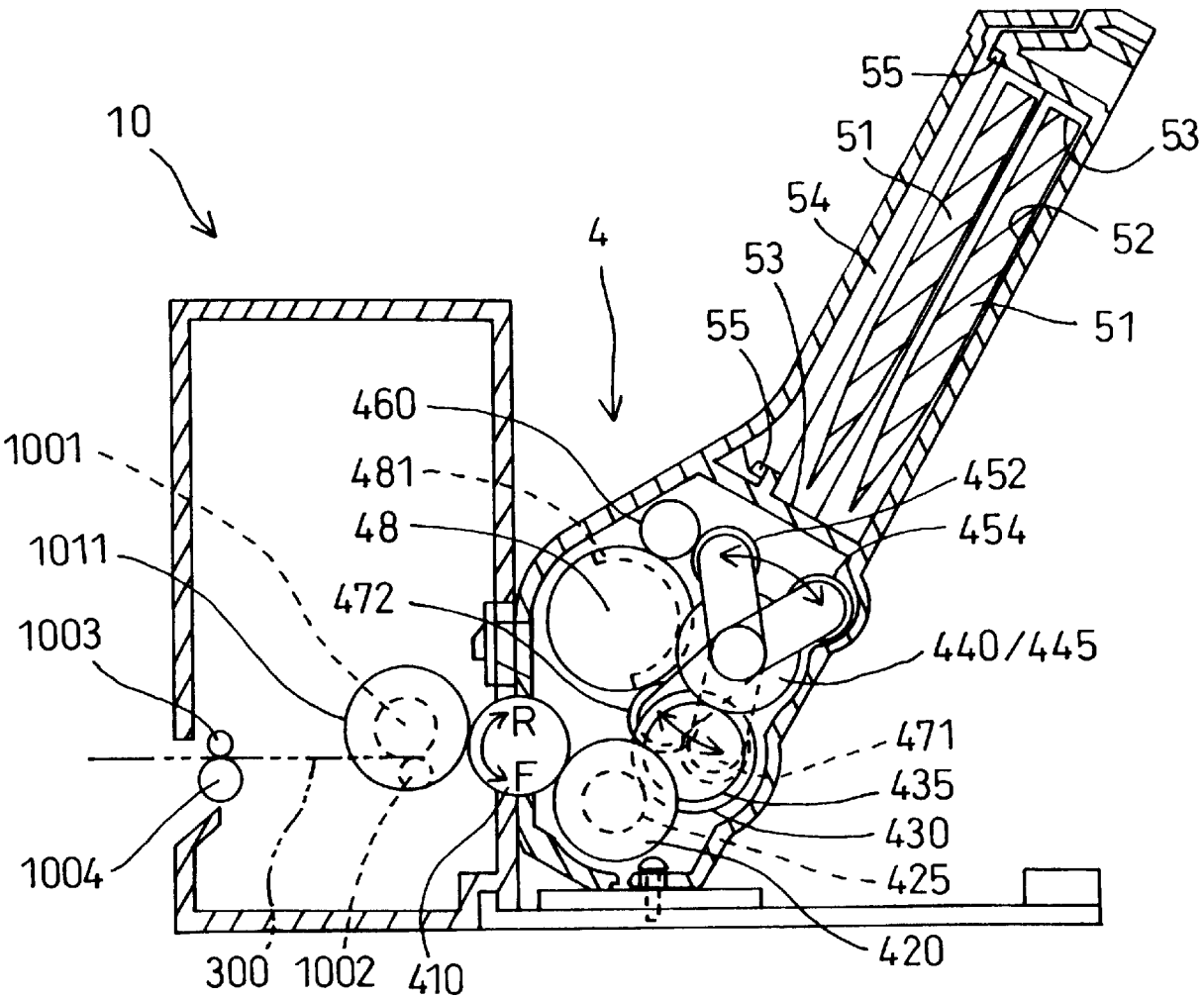
FIG. 10 is a schematic view illustrating a roller axis driving section and the image forming apparatus operated to record an image on a sheet, viewed from the X direction in FIG. 1.

As illustrated in FIG. 1, at the bottom section of the automatic cut-sheet feeder 1, slender, plate-like legs 7 made of a somewhat elastic synthetic-resin are axially attached to the body frame 8 with their axis supporting sections 72 and leg engaging screws 87, so as to rotate parallel to the bottom face of the body frame 8. The legs 7 are rotated and spread so that the longitudinal direction of the legs 7 perpendicularly crosses the longitudinal direction, i.e., width direction, of the automatic cut-sheet feeder 1. The supporting sections 71 of the legs 7, shown in FIG. 3, are extended to the backward side of the point directly under the center of the gravity of the feeder 1 so as to support the weight of the feeder 1 independently. As shown in FIGS. 2, 3 and 10, the end sections of the supporting sections 71 are equipped with rectangular, plate-like stoppers 74 which are extended to be obliquely upwards inclined at about 45 degrees from the direction where the legs 7 are most proximate when the legs 7 are spread. The upper tip surface of the front end section of the leg 7 is equipped with an leg engaging hook 73, which is a nail-like projection. The legs 7 are rotated in the same direction as the longitudinal direction of the automatic cut-sheet feeder 1 so that the legs 7 will be received under the bottom of the body. As a result, the legs do not significantly protrude from the feeder body frame 8 when carrying the feeder. When the legs 7 are received under the bottom of the body frame 8, the rotation of the legs 7 is restricted by the stoppers 74 to positions where the legs have been just received. When the legs 7 are to be pulled out, they can be pulled out by removing the stopper 74.

As shown in FIG. 1, the sheet feeding roller section 3 and the roller axis driving section 4 of the body frame 8 have two body engaging hooks 85. Each of the body engaging hooks 85 is a thin iron plate which has an L-shaped end section and a recessed lower section. The body engaging hook 85 is a projection disposed at a section of an axis receiving plate 49, shown in FIG. 2, of a roller axis 34 (described later), and penetrates through the body frame 8.

The automatic cut-sheet feeder having the above-mentioned structure is attached to the printer 10 as explained below.

Figure 11:
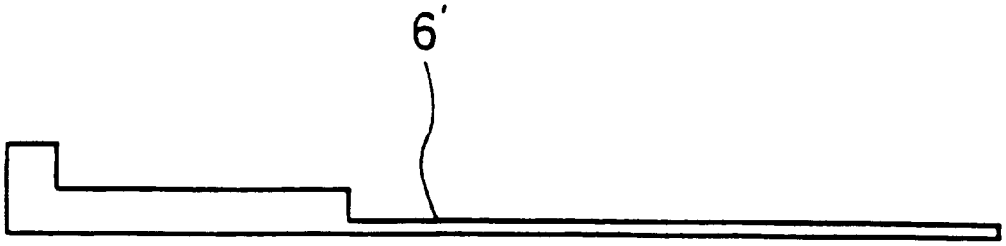
FIG. 11 shows a variation of the extendible guide according to the present invention.

The legs 7 are rotated in the direction crossing the longitudinal direction of the bottom section of the body 8, so that the legs 7 engage the printer 1 as shown in FIG. 1. Subsequently, as shown in FIGS. 10 and 11, the body engaging hooks 85 are inserted into the engaging sections 1006 of the printer 10, and then the L-shaped end sections of the body engaging hooks 85 are engaged with the engaging sections 1006 and fixed thereto. Furthermore, the leg engaging hooks 73 at the front end of the legs 7 are warped downwards by use of the elasticity of the legs 7 so that the projections of the leg engaging hooks 73 are fixed into the recesses of the engaging sections 1007 of the printer 10 to engage the engaging hooks with the engaging sections 1007. When the automatic cut-sheet feeder 1 is attached to the printer 10 in this manner, a sheet discharging opening 84 of the feeder 1 is associated and connected with a sheet inserting opening 1008 and a feeding roller gear 1011 is also meshed with a driving force transmitting gear 400 to be fixed to the gear 400.

As shown in FIGS. 1 and 10, in the sheet feeding section 2, a cover 81 for this section 2 is axially supported with an engaging axis 811 so as to be freely opened and closed. When the cover 81 is opened, a projection-shaped stopper 812 for restricting the opening degree thereof is located in a projected form inside the cover 81 and at a position near the engaging axis 811. The stopper 812 is brought into contact with the sidewall 212 of a rolled plate 21 to restrict the opening degree of the cover 81. At the top position of the sheet stacking section 2, a sheet inserting opening 83 is formed so that when the cover 81, is closed the opening 83 serves as an opening into which a recording sheet is inserted.

As illustrated in FIGS. 1 and 10, the inside of the sheet stacking section 2 is equipped with the rolled plate 21 made of a material in a rectangle plate form. The rolled plate 21 has the same width as that of the U.S. letter size (8½×11 inches), which is a maximum that can be used in the present embodiment. Of course, the device can be modified accordingly to accommodate different size sheets if desired. The rolled plate has a length extending from the vicinity of the sheet inserting opening 83 to the sheet feeding roller 31. The rolled plate 21 comprises a rolled plate-bottom plate 211 for supporting a sheet from its back surface, and side plates 212 that are arranged at both sides of the rolled plate-bottom plate 211 for contacting both sides of a sheet and guiding the sheet. The rolled plate 21 is axially supported by the body frame 8 at the vicinities of both the side ends of the sheet inserting opening 83 by a rolled plate supporting axis 213. The rolled plate 21 is pushed toward sheet feeding rollers 31 with rolled plate springs 214 composed of two coil-springs arranged at the rolled plate 21 back surface near the sheet feeding rollers 31.

As shown in FIGS. 1, 2 and 10, the left side, viewed from the front, on the rolled plate 21, is equipped with a rolled plate sideguide 23 which can slide in the horizontal direction for guiding a sheet in accordance with its width. A rolled plate sideguide-bottom plate 231 which is the main member of the rolled plate sideguide 23, is preferably a rectangular, thin plate whose width is about one-fifth as wide as the rolled plate 21 and whose length is about two-thirds as long as the rolled plate 21. The rolled plate sideguide-bottom plate 231 is positioned to contact the surface of the rolled plate 21. A rolled plate sidewall 232 arranged in a wall at the left end section of the rolled plate sideguide-bottom plate 231 guides the side edge of a sheet 300. The bottom plate 211 of the rolled plate 21 has an opening extending horizontally in the width direction as a connecting opening 236. A rolled plate sideguide-bottom plate 231 is connected to a slider 234 through the connecting opening 236, as shown in FIG. 1. Rows of ratchets on rail 235 are laid opposite to each other, horizontally in the width direction of the sheet, on the back surface of the rolled plate-bottom plate 211 of the rolled plate 21. The slider 234 has ratchet pawls 237 as its upper and lower sections. The slider 234 is disposed so as to slide in the horizontal direction by guide of the ratchet rail 235. The rolled plate sideguide 23 slides in the horizontal direction on the surface of the rolled plate 21 by guide of the slider 234. The ratchet pawls 237 of slider 234 are engaged with the pawls of the ratchet rail 235, so that the rolled plate sideguide 23 is fixed onto a desired position.

Figure 8:
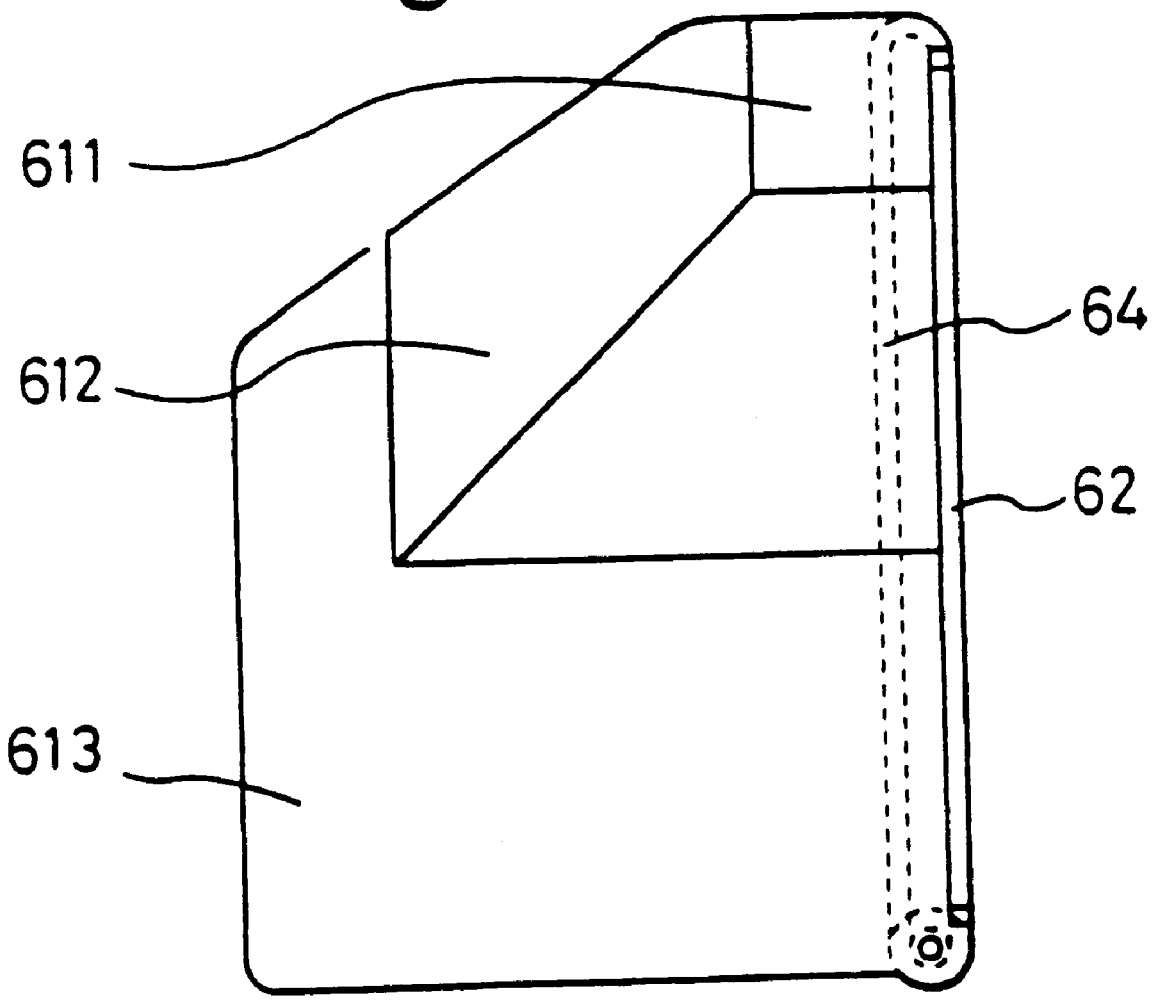
FIG. 8 is a view illustrating the spread extendible guide, viewed from the Y direction in FIG. 1.
Figure 9:
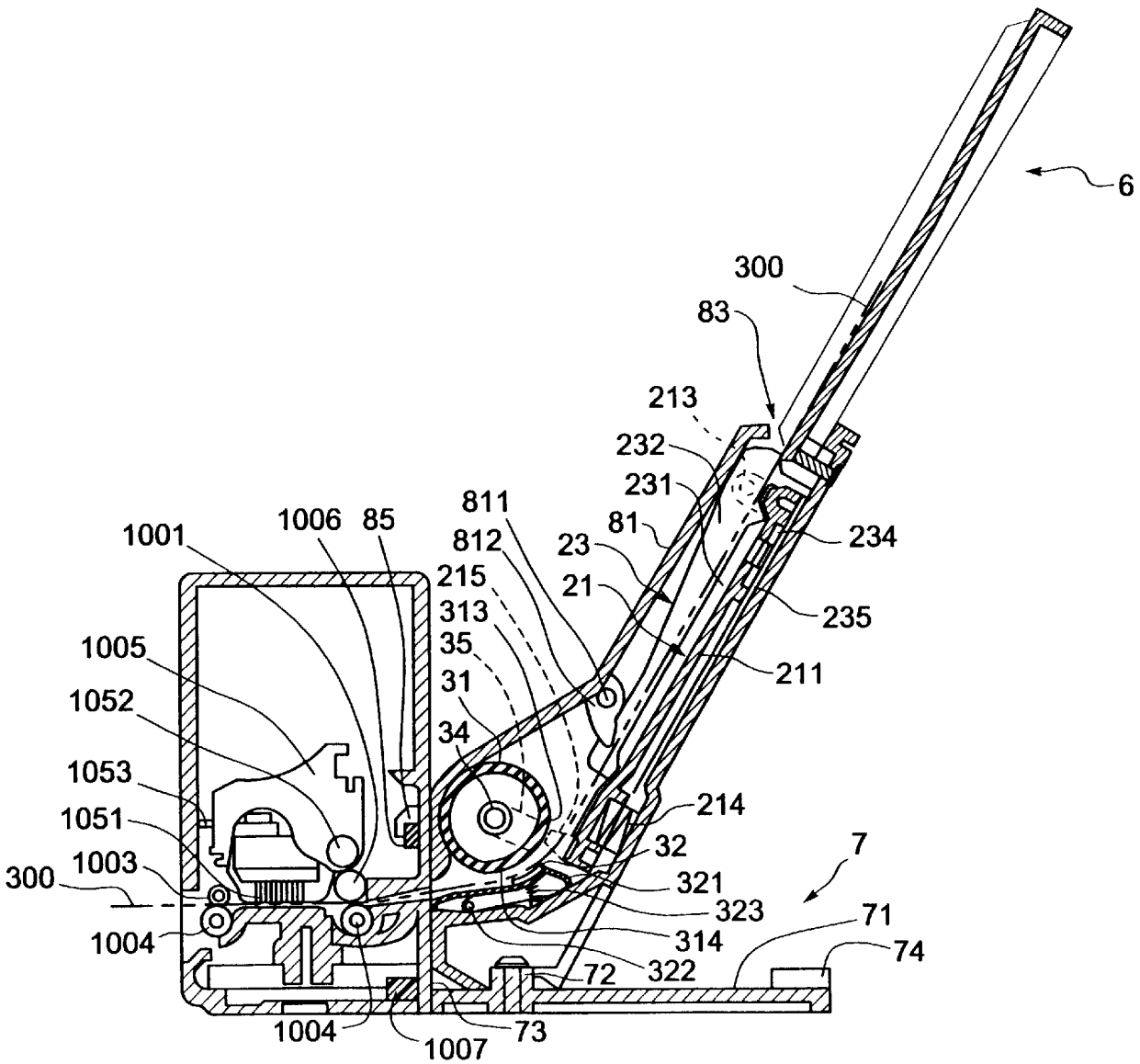
FIG. 9 is a sectional view illustrating the automatic cut-sheet feeder and an image forming apparatus operated to record an image on a sheet, viewed from the X direction side in FIG. 1.

The extendible guide 6 is arranged as shown in FIG. 2, including a pair of right and left extendible sub-guides 66 and 67 arranged in a manner that the respective corner positions thereof are supported with axes. The following will describe the extendible sub-guide 6 using, as an example, the extendible guide 66 arranged at the right side viewed from the front, which is shown in FIG. 2. When the extendible guide 66 is spread for use as shown in FIG. 2, its bottom section 61 has a pentagonal shape as a whole, that is, such a shape that the left upper section of the rectangle-shaped bottom section 61 is cut and can support the sheet 300 from its back face shown in FIG. 8. The bottom section 61 has an outwardly protruding section 61 1 which is a square plane section parallel in the surface of the sheet at the vicinity of the right upper corner at the upstream side in the sheet feeding direction and the side corresponding to the side edge of the sheet. The outwardly protruding section 611 which is higher than other sections of the bottom section 61 including a transitional surface that is a slope section 612 and a lowest section 613. The slope section 612 is formed to continue the side of the outwardly protruding section 611. At the lower and left parts of the bottom section 61 which continue the slope section 612, the lowest section 613 is located to form an L-shaped surface parallel to the surface of the sheet 300.

Figure 6:
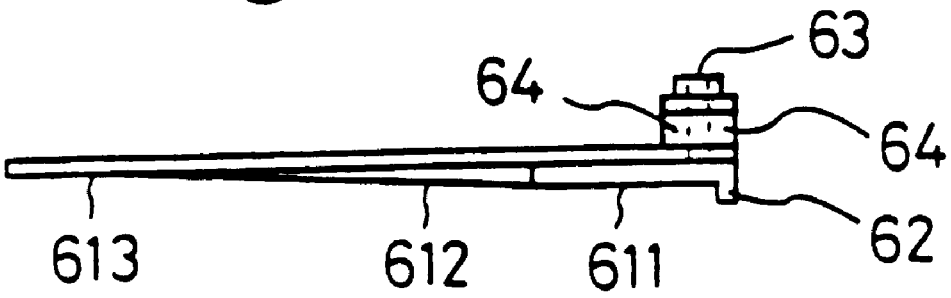
FIG. 6 is a view illustrating the spread extendible guide, viewed from the Z direction in FIG. 1.
Figure 7:
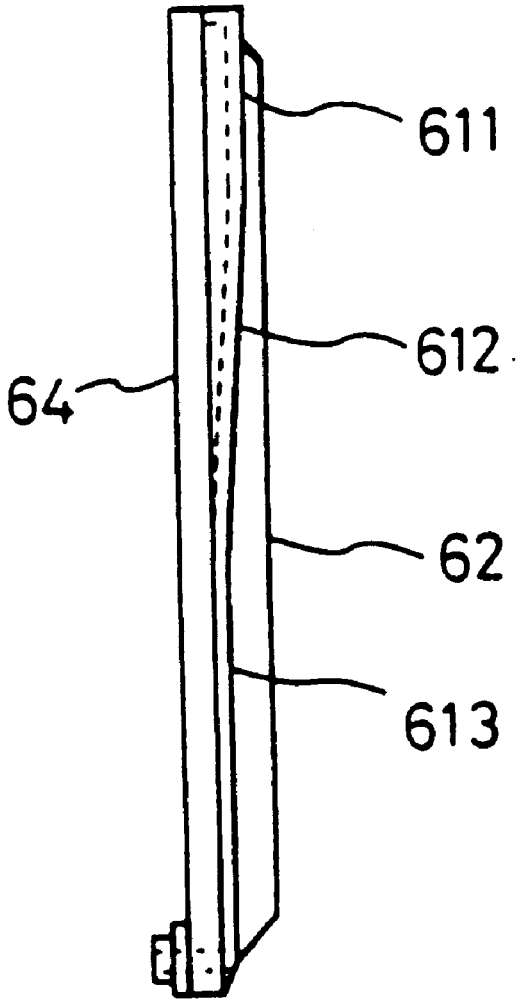
FIG. 7 is a view illustrating the spread extendible guide, viewed from the opposite direction to the X direction in FIG. 1.

A extendible guide sidewall 62 is disposed to span the entire length of the side corresponding to the sheet side edge of the bottom section 61. The extendible guide sidewall 62 is higher than the outwardly protruding section 611 and guides the sheet 300 using the sheet side. The back face of the extendible guide sidewall 62 is equipped with a reinforcing section 64, which is a hollow projection in a race track-like form, i.e., a ring form as shown in FIG. 6. The reinforcing section 64 functions as a supporting member in the case of spreading the extendible guide 6. The outside ends of the extendible guide sidewall 62, the bottom section 61 and the reinforcing section 64 are on the same plane to constitute a side wall 20.

Figure 5:
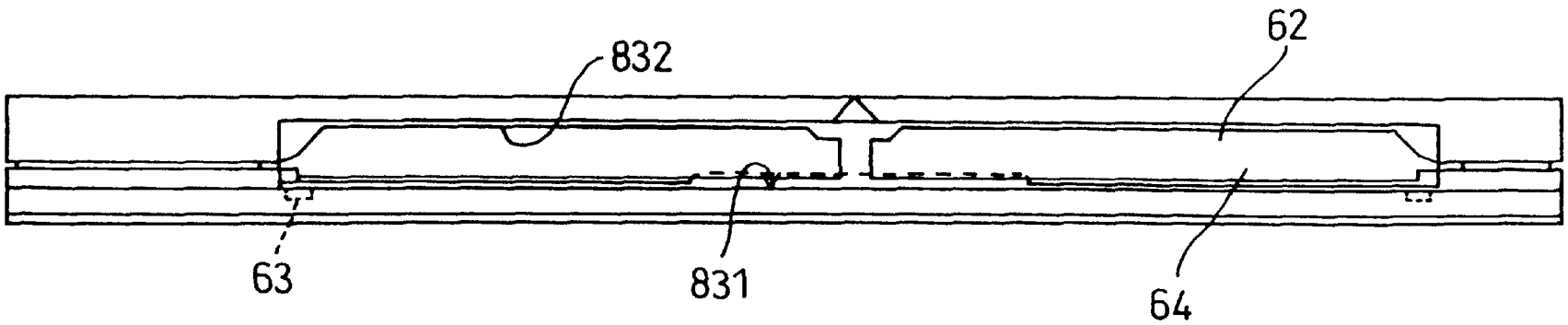
FIG. 5 is a view illustrating the location of the sheet inserting opening in the feeder in which the extendible guide is closed, viewed from the X direction in FIG. 1.

An axis supporting section 63 is located in a two-step cylinder form at the lower end section of the reinforcing section 64 to project downwards from its back face as shown in FIGS. 5 and 6. As shown in FIG. 3, the axis supporting sections 63 are supported from the back face with engaging screws 631 at the vicinities of both ends, at the side of the body 831, of the sheet feeding inserting opening 83. The left extendible sub-guide 67 viewed from the front is the same as the right extendible sub-guide 66 except that the former is arranged symmetrically with the latter.

Figure 4:
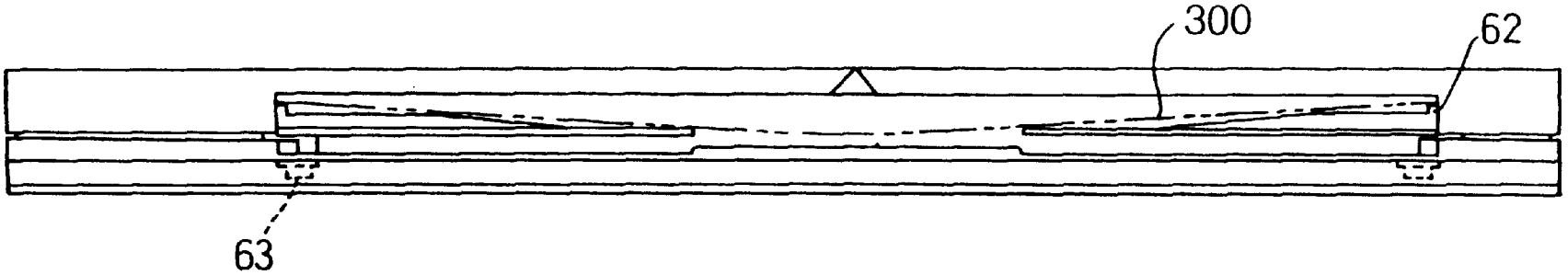
FIG. 4 is a view illustrating the location of a sheet inserting opening in the feeder in which the extendible guide is spread, viewed from the X direction in FIG. 1.

In using the automatic cut-sheet feeder 1, the extendible guide 6 is spread so as to extend toward the upstream side in the sheet 300-feeding direction and substantially onto the same face of the rolled plate 21, as shown in FIGS. 2 and 4. As shown in FIG. 4, when the sheet 300 is stacked on the feeder 1, both the right and left sides of the sheet 300 are supported at the back face by the right and left outwardly protruding sections 611. The central section, between the above-mentioned side of the sheet 300 is supported with the lowest sections 613. The central section of the sheet 300 is positioned at the space between the right and left sub-guides 66 and 67. Therefore, the extendible guide 6, comprised of the right and left sub-guides 66 and 67, supports the sheet 300 as follows. The upstream section of the sheet 300 is curved so that it becomes outwardly protruding in the downward direction.

As shown in FIGS. 3 and 5, in carrying the feeder 1, the extendible guide 6 is axially rotated around the axis supporting section 63 to be received inside the sheet stacking section 2. When the right and left extendible sub-guide 66 and 67 are rotated and received in such a manner as above, the sub-guides 66 and 67 can stay inside the sheet stacking section 2 without interfering with each other since each of the bottom sections 61 have a shape like a pentagon or a rectangle with a corner cut off. The received bottom sections 61 overlap the rolled plate 21 and the extendible guide sidewalls 62 are received into the sheet inserting opening 83. In this case, the end sections of the extendible guide sidewall 62, the bottom section 61 and the reinforcing section 64 are on the same plane to constitute the single extendible guide sidewall 62, as described above. Consequently, the extendible guide sidewall 62 functions as a cover for the sheet inserting opening as illustrated in FIG. 4. The end section of the extendible guide sidewall 62 and the end section of the extendible guide reinforcing section 64 intimately contact the edge 832 of the cover and the edge 831 of the body frame 8 to prevent intrusion of alien substances from the outside. The received extendible guide 6 is engaged and fixed with the stopper 813 projecting in a curved form at the edge 831 of the body. Thus, the extendible guide 6 is prevented from being spread undesirably and prevented from being projected outward during carrying of the feeder 1. If the cover 81 is opened, the extendible guide 6 can be easily spread.

As illustrated in FIG. 10, two sheet feeding rollers 31 are disposed near the rolled plate 21 end, which is at the downstream side of the sheet stacking section along the sheet feeding direction, at positions located inside the sheet side end of the sheet stacking section by a distance of one-third the sheet width. The rollers 31 are rotated together with the roller axis 34. The sheet feeding rollers 31 are arranged to contact the surface of the downstream end section in the sheet feeding direction of the rolled plate 21. The rollers 31 have an arcuate contact surface 312 which can contact the sheet 300 with a high frictional coefficient and non-contact surfaces 313 and 314 composed of planes which do not contact the sheet 300. The side section of the rollers 31 preferably has a D-shape. As shown in FIG. 2, at both sides of each of the right and left sheet feeding rollers 31, disk-like collars 33 are provided for preventing curl of the sheet 300. These collars 33 have a low friction coefficient against the sheet 300 and are supported with the roller axis 34 but are not fixed onto the axis 34. The outer diameter of the collars 33 is somewhat smaller than that of the contact surface 312 of the sheet feeding roller 31 and somewhat larger than the distance from the non-contact surface 313 to the rotational center of the sheet feeding roller 31. The rolled plate 21 is furnished with rolled plate pads 216 composed of a thin cork plate with a middle-class frictional coefficient. The plate pads 216 are located at the sections contacting the sheet feeding rollers 31 and disk-like collars 33.

A holder 321 having separating pads 32 is disposed directly under the downstream side of the point where the sheet feeding roller 31 and the rolled plate 21 contact each other. In this holder 321, the separating pads 32 are axially supported with a supporting axis 322, to freely move up to and down from the rollers 31 and be swung. The separating pads 32 are urged toward the rollers 31 with springs 323. The separating pads 32 are composed of a material having a frictional coefficient, such as a rubber, and are for preventing feeding a stack of two or more sheets simultaneously. The length, along the sheet width, of the separating pads 32 of the holder 321 is as long as the separating pad 32 so that the separating pad 32 can face the right and left sheet feeding rollers 32 and collars 33, as shown in FIG. 2.

As shown in FIGS. 2 and 10, a rolled plate cam 35 is in a rod projection-shape whose tip has a V-shaped recess and is fitted to the circumference of the roller axis 34. A rolled plate cam follower 215 in a triangle shaped projection is disposed at the downstream end section of the right and left rolled plate sidewalls 232. The cam follower 215 is arranged to be pressed against the rolled plate cam 35. The projection of the rolled plate cam 35 is pressed against the cam follower 215 so that the cam follower 215 is fitted into the recess of the triangle shaped projection, when the non-contact surface 313 and the non-contact surface 314 of the sheet feeding roller 31 are opposite the rolled plate pad 216 and the separating pad 32, respectively. The rolled plate 21 pressed by the rolled plate cam follower 215 is swung downwards so that the sheet feeding rollers 31 and the collars 33 are away from the rolled plate pads 216. The separating pads 32 are opposite the non-contact surface 314 of the sheet feeding rollers 31; however, the separating pads 32 contact the collars 33 since the outer surfaces of the collars 33 are at the outer side relative to the non-contact surfaces 314.

In the following description, the state when the rolled plate cam follower 215 is fitted into the rolled plate cam 35 is referred to as an "initial phase", and the state that the follower 215 is removed from the cam 35 is referred to as a "rotation phase".

In the case of the rotation phase, the contact surfaces 312 contact the sheet 300 but the collars 33 do not contact the sheet 300 since the outer diameter of the contact surfaces 312 of the sheet feeding rollers 31 is larger than that of the outer diameter of the collars 33, as described above.

The roller axis 34 is rotatably supported with axis supporting plates 49 composed of iron thin plates screwed down to the body frame 8. The end section of the roller axis 34 supported with the right axis supporting plate 49 viewed from the front is equipped with a sheet feeding gear 48 as illustrated in FIG. 11. The driving force generated by a driving motor and a transmitting gear mechanism (which are not illustrated) disposed at the printer 100 is transmitted with the gear 48 to a driving force gear 41 of the automatic cut-sheet feeder 1. Subsequently, the driving force is transmitted to the sheet feeding gear 48 through the roller axis driving section 4 to drive the roller axis 34.

The roller axis driving section 4 will now be described more specifically. As shown in FIG. 1, a gear 410, which is a driving force transmitting gear protected by a gear protecting plate 86, is projected out from an opening of the body frame 8. As shown in FIG. 11, a driving force is provided to a feeding roller gear 1011 of the printer by means of the non-illustrated driving motor and transmitting gear mechanism. The automatic cut-sheet feeder 1 is fitted to the printer 10 with a leg engaging hook 73 and a body engaging hook 85 described later. The gear 410 is meshed with the feeding roller gear 1011 so that the driving force provided to the feeding roller is transmitted to the gear 410. Thus, the gear 410 is rotated forward, that is, in the F direction, or is rotated reversibly, that is, in the R direction, in accordance with the rotation direction of the non-illustrated driving motor. As shown in FIGS. 1 and 11, from the gear 410, the driving force is transmitted in the order of a large gear 420, a small gear 425, a large gear 430 and a small gear 435, while the speed of the gears falls down in this order. After that, the driving force is transmitted to an outer gear 440. The axis of the outer gear 440 also has an inner gear 445 having the same diameter and number of teeth as the outer gear 440. A first pendulum gear 450, which is a planet gear, is disposed next to the outer gear 440, and a second pendulum gear 470, which is a planet gear, is disposed next to the inner gear 445.

The direction along which a sheet is fed with the feeding roller 1001 of the printer 10 is referred to as a forward direction. If the feeding roller gear 1011 is rotated in the reverse direction, the gear 410 is rotated clockwise, that is, in the R direction in the FIG. 11, which is a section viewed from the right side. At that time, the outer gear 440 and inner gear 445 are rotated counterclockwise so that the first pendulum gear 450 is rotated and shifted to the position 452. Thus, the gear 450 is meshed with a gear 460. On the contrary, a second pendulum gear 470 is rotated and shifted to the position 74. Thus, the gear 470 is not meshed with the sheet feeding gear 48.

In the opposite direction, when the feeding roller 1001 of the printer 10 is rotated forward to feed a sheet in the forward direction, the gear 410 is rotated forward, that is, in the F direction in the FIG. 11. At that time, the outer gear 440 and inner gear 445 are rotated clockwise, so that the first pendulum gear 450 is rotated and shifted to the position 454. Thus, the gear 450 is not meshed with the gear 46. On the contrary, the second pendulum gear 470 is rotated and shifted to come to the position where the gear 470 can mesh with the sheet feeding gear 48. The sheet feeding gear 48 has, over its whole circumference, teeth so as to mesh with the gear 460 constantly as shown in FIG. 3. However, the face of gear 48 which meshes with the second pendulum gear 470 has a non-teeth section 481, which has no teeth, at such a position as in FIG. 3.

For this reason, when the feeding roller 1001 is rotated reversibly, the driving force is transmitted to constantly rotate the sheet feeding roller in the right rotation direction on the FIG. 10, i.e., in the sheet feeding direction since the first pendulum gear 450 is meshed with the sheet feeding gear 48 through the gear 460. However, the feeding roller 1001 is rotated forward, when the sheet feeding roller gear 48 is rotated so that the teeth-engaging section arrives at the non-teeth section 481, the rotation of the sheet feeding roller gear 48 is stopped even under the condition that the driving force is transmitted from the second pendulum gear 470 to the roller gear 48 and the gear 470 is being rotated after the arrival. The state of the position where the rotation is stopped is the initial phase. Namely, in the case of the forward rotation, the rolled plate cam follower 215, associated with the sheet feeding rollers 31, is fitted into the rolled plate cam 35 so that the rolled plate 21 is pressed and swung downwards with the follower 215 and then the rotation of the sheet feeding rollers 31 is stopped at the position where the non-contact surfaces 313 and the rolled plate pads 215 face each other. Thus, the sheet feeding rollers 31 and the collars 33 are off from the rolled plate pad 215. The separating pads 32 face the non-contact surfaces 314 of the sheet feeding rollers 31 to contact the collars 33.

The ink cartridge 51 used in the printer 300 according to the present embodiment is preferably an ink jet type using a liquid ink, and contains a liquid ink. The cartridge 51 has an ink bag placed into a plastic case. An ink cartridge receiving section 5 has such a size that the plastic case is fitted into this section 5 and can receive two cartridges according to the embodiment.

The following will describe the action of the automatic cut-sheet feeder 1 according to the embodiment attached to the printer 100. Firstly, the cover 81 for the sheet stacking section is opened to spread the extendible guide 6. Then, the right side, which is viewed from the front, of a stack of printing sheets 300 is brought into contact with the sidewall 212 of the rolled plate 21. Subsequently, the rolled plate sideguide 23 is slid correspondingly to the width of the printing sheets 300 to bring the rolled plate sidewall 232 of the rolled plate sideguide 23 into contact with the other side of the sheets 300. The front ends of the sheets 300 are inserted inside the sheet stacking section 2 along the rolled plate-bottom plate 211 of the rolled plate 21. At this time, the sheets are set so that their front ends contact the upper end of the separating pad holder 321.

When image information is input into the printer 100, the non-illustrated driving motor is rotated by the direction from the non-illustrated controller of the printer 100. In the present embodiment, at first, the driving motor is rotated in the direction reverse to the sheet feeding direction. The rotation of the driving motor makes the feeding roller gear 1011 rotate in the reverse direction through the nonillustrated driving force transmitting mechanism, so that the gear 410 is rotated in the R direction in FIG. 11. The outer and inner gears 440 and 445 are rotated counterclockwise so that the first pendulum gear 450 is rotated and shifted to the position 452 to mesh with the gear 460. The second pendulum gear 470 is rotated and shifted to the position 474, which is a position where the gear 470 does not mesh with the sheet feeding gear 48. As a result, the driving force is transmitted from the first pendulum gear 450 through the gear 460 to the sheet feeding roller gear 48 so as to constantly rotate the sheet feeding roller in the right direction in FIG. 10, that is, in the sheet feeding direction.

The sheet feeding roller 31 is at first under the initial phase. Thus, the rolled plate cam follower 215 is fitted into the rolled cam 35 so that the rolled plate 21 is pressed with the cam follower 215 to be positioned downward. As a result, the sheet feeding roller 31 is at the position where the non-contact surface 313 faces the rolled plate pad 216. The sheet feeding roller 31 and collars 33 have a space between them and the rolled plate pad 216. The printing sheets are inserted into that space. The separating pad 32 faces the non-contact surface 314 of the sheet feeding roller 31 to contact the collars 31. As the sheet feeding roller 31 is rotated, the state of the roller 31 is changed into the rotation phase. Namely, the contact surface 312 of the sheet feeding roller 31 contacts the sheet, but the collars 33 do not contact the sheet. The uppermost sheet 300, of the stack of the plural sheets, which contacts the contact surface 312 of the roller 31 is fed with the surface 312, but the sheets below the uppermost sheet 300 are prevented from being fed by friction caused by the separating pad 32 so that the sheets remain inside the sheet stacking section 2. The single sheet 300 fed with the surface 312 is further fed from the sheet discharging opening 84 of the feeder 1 through sheet inserting opening 1008 of the printer 10 into the printer 10. When the front end of the fed sheet reaches the feeding roller 1001 of the printer 10, the front end appears to enter between the feeding roller 1001 and the trailing roller 1002 but indeed cannot enter between them so that the sheet 300 is warped. This is because the feeding roller 1001 rotates in the direction reverse to the sheet feeding direction. As a result, the front end of the sheet 300 is uniformly pressed against the feeding roller 1001 so that oblique feeding of the sheet 300 is corrected.

When this correction is finished, with a non-illustrated sensor for sheet the rotation of the driving motor is reversed so that the motor rotates in the forward direction. When the motor rotates in the forward direction, the driving force is transmitted from the second pendulum gear 470 to the sheet feeding roller gear 48 so that the sheet feeding roller gear 48, which is meshed with the second pendulum gear 470, makes the sheet rotate in the feeding direction in the same manner as when the motor rotates in the reverse direction. As a result, the sheet is fed in succession with the feeding roller 31. The sheet is put between the feeding roller 1001 and the trailing roller 1002 rotating in the forward direction of the printer 10 and further is fed. When the sheet feeding roller gear 48 is rotated so that the second pendulum gear 470 comes in contact with the non-teeth section 481, meshing between the teeth second pendulum gear 470 and the sheet feeding roller gear 48 ends. Thus, even if the pendulum gear 470 rotates, the rotation of the roller gear 48 is stopped. The rotation of the sheet feeding roller gear 48 is stopped when the rotation phase is changed into the initial phase. At that time, the sheet feeding roller 31 is off from the sheet and the rotation thereof is stopped. However, the sheet is fed in succession with the sheet feeding roller 1001 of the printer 10. When the sheet reaches a predetermined printing position, the position of the sheet is detected with the second sensor for the sheet, which is not illustrated, so that printing is started while a carrier 1005 having a print head 1051 is moved by guide with the guide rod 1052 and the guide rail 1053. When the printing is finished, the sheet 300 is fed until the sheet 300 is discharged from the sheet discharging opening 1009 by the direction from the non-illustrated controller.

The present embodiment having the above-mentioned structure has the following advantages.

The automatic cut-sheet feeder 1 according to the present embodiment has the sheet stacking section 2 for stacking the sheet 300, the extendible guide 6 for supporting the sheet 300 from its back surface disposed at the upstream side along the sheet feeding direction of the sheet stacking section 2 and the extendible guide 6 that has the lowest section 613 positioned at the central side along the sheet width direction lower than the outwardly protruding section 611. For this reason, the form of the sheet 300 stacked on the sheet stacking section 2 follows the shape of the bottom section 61 of the extendible guide 6 which the back surface of the sheet 300 contacts. Therefore, the sheet 300 stacked on the extendible guide 6 of the section 2 is bent roundly around its upper end and central section to form into a curved surface. As a result, the upper end section of the sheet becomes stiff to result in an advantage that the sheet is not liable to hang down and afterwards.

The extendible guide 6 also includes a pair of axis supporting sections 63 located at the upper and lateral sides of the sheet stacking section 2 so as to be freely rotated and received inside the section 2 by the rotation of the guide 6. Accordingly, the guide 6 can at maximum have the same length as the total width of the sheet. Consequently for the same automatic cut-sheet feeders, the guide 6 can be extended longer than the prior extendible guide which can be pulled in and out linearly for storage and expansion.

The extendible guide 6 has the bottom section 61 for supporting the sheet 300 from its back surface and extendible guide sidewalls 62 for guiding the sheet 300 from its side edges. Further, when the pair of sub-guides 66 and 67 of the extendible guide 6 is received inside the sheet stacking section 2, the sheet inserting opening 83 of the section 2 is closed with the extendible guide sidewalls 62. Therefore, it is possible to prevent invasion to some degree, of alien substances into the small-sized automatic cutsheet feeder when the feeder is carried. Even if the feeder is used without being carried, such invasion, as above, can be reduced.

The automatic cut-sheet feeder 1 has slender legs 7 which are axially and rotatably in the horizontal direction supported at the bottom section of the feeder 1. The slender legs 7 are rotated in the direction crossing the longitudinal direction of the bottom section to support the feeder 1 in such a manner that the feeder 1 can independently stand up. The feeder 1 also has leg engaging hooks 73 which are disposed at the end sections of the legs 7. The end sections are positioned at the printer 10 side when the legs 7 are rotated in the longitudinal direction of the bottom section. The end sections and leg engaging hooks 73 make the engagement of the feeder 1 with the printer 10 possible. Therefore, even if the feeder 1, which is large in comparison to the printer 10, is fitted to the printer 10, the legs 7 can support the printer so as not to lose stability. Even if the engagement with the printer 10 is released to make the feeder 1 independent, the feeder 1 can stand up by itself. Also, when the feeder 1 is stored with, the legs 7 require a small storage area. Thus, only a small space for the storage is necessary.

Furthermore, the legs 7 are axially coupled to the bottom section of the feeder 1 to be freely rotated. Therefore, the legs 7 can be rotated toward the bottom section and be received by overlapping the bottom section. Thus, the portability of the feature apparatus is not sacrificed.

The printer 10 side end section of the legs 7 is equipped with the leg engaging hooks 73. Thus, even if another hook is not disposed, the legs 7 can be used so that the feeder 1 can engage with the printer 10. The feeder 1 also has body engaging hooks 85 for engaging the printer 10. The body engaging hooks 85 and the leg engaging hooks 73, which have only simple structure, are used to engage the feeder 1 with the printer 10 securely.

The present invention has been described on the basis of a preferred embodiment. The present invention is however not limited to this embodiment, and various improvements and modifications can be applied thereto within the scope of the invention.

Figure 12:
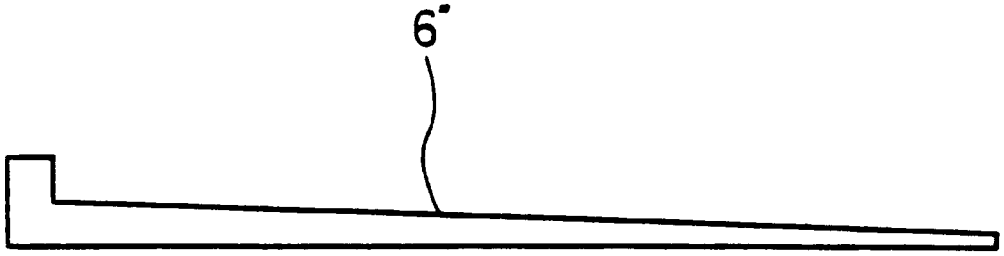
FIG. 12 shows another variation of the extendible guide according to the present invention.

In the above-mentioned embodiment, for example, the extendible guide bottom section 61 is composed of the square outwardly protruding section 611, the slope section 612 which continues the outwardly protruding section 611, and the lowest section 613; however, the bottom section 61 may be any shape which makes it possible to curve the upper end section of the sheet 300 to such a degree that this section of the sheet 300 does not hang down when the bottom section 61 supports the sheet 300. Thus, the bottom section 61 may be one which does not have the slope section 612, as shown in FIG. 12, and one composed of only the slope section 612 as shown in FIG. 13. Alternatively, the slope section 612 could be formed as a series of raised steps. In short, the bottom section 61 supporting the central section of the sheet, along the sheet width direction, is lower than the side sections supporting the side sections of the sheet, along the width direction, can obtain the advantage of the present invention.

What is claimed is:

1. A cut-sheet feeder in which sheets are fed in a sheet feeding direction comprising:

a sheet stacking section for stacking at least one sheet; and an extendible guide for supporting the at least one sheet at a back surface of the sheet, the extendible guide being disposed at an upstream side of the sheet stacking section in the sheet feeding direction, the extendible guide comprising a supporting surface, the supporting surface including a central section and a side section along a width direction of the supporting surface, the central section being lower than the side section, the surface of the extendible guide supporting the at least one sheet so that the at least one sheet is curved in the width direction of the at least one sheet, wherein the extendible guide includes a sub-guide member, disposed along the upstream side of the sheet stacking section in the sheet feeding direction, the sub-guide member being arranged to be received inside the sheet stacking section, wherein the sub-guide member of the extendible guide includes the side section of the supporting surface of the extendible guide, wherein the sub-guide member of the extendible guide includes a bottom portion that forms part of the central section of the supporting surface of the extendible guide.

2. The cut-sheet feeder of claim 1, further comprising:

a body frame, including the sheet stacking section, with a bottom section; and a leg supporting the feeder, the leg axially connected to the bottom section and rotated horizontally along a direction crossing a longitudinal direction of the bottom section, the leg including an end section positioned near the image forming apparatus when the leg is rotated horizontally along the direction crossing the longitudinal direction of the bottom section, and an engaging section disposed at the end section of the leg engagable with the image forming apparatus.

3. The cut-sheet feeder of claim 1, wherein the upstream side of the sheet stacking section in the sheet feeding direction comprises an upper side and two lateral side of the sheet stacking section, the pair of sub-guides of the extendible guide are axially supported by the upper side and both lateral sides of the sheet stacking section, the pair of sub-guides are mounted for rotation into the sheet stacking section.

4. The cut-sheet feeder of claim 1, wherein the sub-guide includes a raised side section with a transitional surface.

5. The cut-sheet feeder of claim 4, wherein the transitional surface is inclined.

6. The cut-sheet feeder of claim 4, wherein the transitional surface includes steps.

7. The cut-sheet feeder of claim 5, wherein the raised sections is disposed in a corner of the sub-guide so that the at least one sheet is curved in the width direction of the at least one sheet.

8. The cut-sheet feeder of claim 1, wherein the sub-guide further comprises a sidewall for guiding the at least one sheet using a side edge of the at least one sheet; and the sheet stacking section comprises sheet inserting openings, each sheet inserting opening being closed with the sidewall of the sub-guide when the sub-guide is received inside the sheet stacking section.

9. The cut-sheet feeder of claim 1, wherein the extendible guide includes a pair of sub-guide members disposed along the upstream side of the sheet stacking section in the sheet feeding direction, each sub-guide member being arranged to be received inside the sheet stacking section, wherein each sub-guide member of the extendible guide includes a side section of the supporting surface of the extendible guide, wherein each sub-guide member of the extendible guide includes a bottom portion that forms part of the central section of the supporting surface of the extendible guide.

10. The cut-sheet feeder of claim 9, wherein the side section is higher than the central section of the extendible guide in both the sheet feeding direction and the width direction of the supporting surface.

11. The cut-sheet feeder of claim 9, wherein the sub-guide further comprises a sidewall for guiding the at least one sheet using the side edge of the at least one sheet; and the sheet stacking section comprises sheet inserting openings, each sheet inserting opening being closed with the sidewall of the sub-guide when the sub-guide is received inside the sheet stacking section.

12. The cut-sheet feeder of claim 1, wherein the extendible guide is positioned so that sheets are fed into the image forming apparatus at an angle relative to the horizontal axis of the image forming apparatus, wherein the angle is between 0 degrees and 90 degrees.

13. The cut-sheet feeder of claim 1, wherein the side section is higher than the central section of the extendible guide in both the sheet feeding direction and the width direction of the supporting surface.

14. The cut-sheet feeder of claim 13, wherein a height of the side section of the extendible guide increases in both the sheet feeding direction and the width direction of the supporting surface.

15. A cut-sheet feeder, engagable with an image forming apparatus, the feeder comprising:

a body frame with a bottom section; and a leg supporting the feeder, the leg axially connected to the bottom section and rotated horizontally along a direction crossing a longitudinal direction of the bottom section, the leg including an end section positioned near the image forming apparatus when the leg is rotated horizontally along the direction crossing the longitudinal direction of the bottom section, and an engaging section disposed at the end section of the leg engagable with the image forming apparatus.

16. The cut-sheet feeder of claim 15, further comprising:

a sheet stacking section for stacking at least one sheet; and an extendible guide for supporting the at least one sheet at a back surface of the sheet, the extendible guide being disposed at an upstream side of the sheet stacking section in the sheet feeding direction, the extendible guide comprising a supporting surface, the supporting surface including a central section and a side section along a width direction of the supporting surface, the central section being lower than the side section, the surface of the extendible guide supporting the at least one sheet so that the at least one sheet is curved in the width direction of the at least one sheet, wherein the extendible guide includes a sub-guide member, disposed along the upstream side of the sheet stacking section in the sheet feeding direction, the sub-guide member being arranged to be received inside the sheet stacking section, wherein the sub-guide member of the extendible guide includes one of the side section of the supporting surface of the extendible guide, wherein the sub-guide member of the extendible guide includes a bottom portion that forms part of the central section of the supporting surface of the extendible guide.

17. The cut-sheet feeder of claim 16, wherein the extendible guide includes a pair of sub-guide members disposed along the upstream side of the sheet stacking section in the sheet feeding direction, each sub-guide member being arranged to be received inside the sheet stacking section, wherein each sub-guide member of the extendible guide includes a side section of the supporting surface of the extendible guide, wherein each sub-guide member of the extendible guide includes a bottom portion that forms part of the central section of the supporting surface of the extendible guide.

18. The cut-sheet feeder of claim 15, further comprising:

a hook coupled to the leg at a first end of the leg and acting in combination with the engaging section to provide engagement between the cut-sheet feeder and the image forming apparatus.

19. The cut-sheet feeder of claim 18, further comprising:

a supporting section at a second end of the leg that prevents over-rotation of the leg.

20. The cut-sheet feeder of claim 18, wherein the engaging section is upwardly protruding and the hook is downwardly extending.

21. A cut-sheet feeder for feeding sheets into a side of an image forming apparatus, the feeder comprising:

a body frame capable of being mounted on a side of the image forming apparatus inclined upwards at an angle from a horizontal face of the image forming apparatus, the body frame comprising an upper section and a lower section, the lower section expanding in width towards a junction with the image forming apparatus;

a sheet stacking section that holds a sheet, the sheet stacking section being located at the upper section of the body frame inside the body frame;

a sheet feeding roller section located inside the lower section of the body frame inside the body frame;

a roller driving section located on a first lateral side of the sheet feeding roller section; and at least one leg coupled to the lower section of the body frame that rotates parallel to the bottom face of the body frame.

22. The cut-sheet feeder of claim 21, further comprising an extendible guide for supporting the sheet at a back surface of the sheet, the extendible guide being disposed at an upstream side of the sheet stacking section in the sheet feeding direction, the extendible guide comprising a supporting surface, the supporting surface including a central section and a side section along a width direction of the supporting surface, the central section being lower than the side section, the surface of the extendible guide supporting the sheet so that the sheet is curved in the width direction of the sheet, wherein the extendible guide includes a sub-guide member, disposed along the upstream side of the sheet stacking section in the sheet feeding direction, the sub-guide member being arranged to be received inside the sheet stacking section, wherein the sub-guide member of the extendible guide includes one of the side section of the supporting surface of the extendible guide, wherein the sub-guide member of the extendible guide includes a bottom portion that forms part of the central section of the supporting surface of the extendible guide.

23. The cut-sheet feeder of claim 22, wherein the extendible guide includes a pair of sub-guide members disposed along the upstream side of the sheet stacking section in the sheet feeding direction, each sub-guide member being arranged to be received inside the sheet stacking section, wherein each sub-guide member of the extendible guide includes a side section of the supporting surface of the extendible guide, wherein each sub-guide member of the extendible guide includes a bottom portion that forms part of the central section of the supporting surface of the extendible guide.

24. The cut-sheet feeder of claim 21, further comprising an ink cartridge receiving section that is capable of receiving an ink cartridge located on a first lateral side of the sheet stacking section above the roller driving section.

25. The cut-sheet feeder of claim 21, in combination with a ink jet printer.

26. The cut-sheet feeder of claim 21, wherein the at least one leg is rotated and spread so that a longitudinal direction of the at least one leg perpendicularly crosses a longitudinal direction of the cut-sheet feeder.

27. The cut-feeder of claim 21, wherein the at least one leg is rotatable in the longitudinal direction of the cut-sheet feeder so that the at least one leg is rotatable and receivable under the lower section of the body frame.

28. The cut-feeder of claim 21, wherein the at least one leg is rotated in the direction crossing the longitudinal direction of the lower section of the body so that the leg engages the image forming apparatus.

29. The cut-sheet feeder of claim 21, wherein the at least one leg is axially attached to the body frame and comprises an axis supporting section and a leg engaging fastener, the axis supporting section being extendible to a point adjacent to a point directly under a center of gravity of the feeder.

30. The cut-sheet feeder of claim 21, wherein the body frame further comprises a sheet inserting opening and a sheet discharging opening associated and connected with the sheet inserting opening; and the cut-sheet feeder further comprises a feeding roller gear and a driving force transmitting gear to be meshed with the feeding roller gear.

31. The cut-feeder of claim 21, wherein the sheet feeding roller section comprises a first engaging hook and the roller axis driving section comprises a second engaging hook, each of the first and second engaging hooks comprising an L-shaped end section and a recessed lower section.

32. The cut-feeder of claim 31, wherein the first engaging hook is insertable into a first engaging section of the image forming apparatus and the second engaging hook is insertable into a second engaging section of the image forming apparatus and the L-shaped end sections of the first and second engaging hooks are engagable with the image forming apparatus engaging sections and fixed thereto.

33. The cut-feeder of claim 32, further comprising a third engaging hook located at a front end of the at least one leg and fixable into a recess of a third engaging section of the image forming apparatus.

* * * * *